US005154971A

United States Patent [19]

Mizutani

[11] Patent Number: 5,154,971

[45] Date of Patent: Oct. 13, 1992

[54] INK RIBBON TO BE USED FOR PRODUCING A DRY TRANSFER MATERIAL

[75] Inventor: Tadashi Mizutani, Nagoya, Japan

[73] Assignee: Brother Kogyo Kabushiki Kaisha, Nagoya, Japan

[21] Appl. No.: 736,930

[22] Filed: Jul. 29, 1991

[30] Foreign Application Priority Data

Aug. 7, 1990 [JP] Japan ..... 2-209442

[51] Int. Cl.[5] ..... B41M 5/165

[52] U.S. Cl. ..... 428/321.5; 428/195; 428/336; 428/914

[58] Field of Search ..... 428/321.5, 914, 403, 428/40, 73, 42, 336, 132, 195

[56] References Cited

U.S. PATENT DOCUMENTS 4,652,486 3/1987 Tasaka et al. ..... 428/321

4,870,427 9/1989 Kobayashi et al. ..... 346/1

FOREIGN PATENT DOCUMENTS 63-251287 10/1988 Japan .

*Primary Examiner*—Bruce H. Hess

*Assistant Examiner*—W. Krynski

*Attorney, Agent, or Firm*—Oliff & Berridge

[57] ABSTRACT

An ink ribbon for producing a dry transfer material having microcapsule encapsulated adhesive coated on the ribbon substrate so that the adhesive is non-functional until the microcapsules are ruptured by pressure. Thus, the microcapsules may contain an adhesive having an adhesive property stronger than that included in the resin having a pressure-sensitive adhesive property of the conventional ink ribbons.

17 Claims, 7 Drawing Sheets

Fig.4(A)

| | SCRATCH STRENGTH |
|---|---|
| SAMPLE 1 | 5.0 |

Fig.4(B)

| | SCRATCH STRENGTH |
|---|---|
| SAMPLE 2 | 5.0 |

Fig.4(C)
RELATED ART

| | SCRATCH STRENGTH |
|---|---|
| CONVENTIONAL SAMPLE | 1~2 |

Fig.5(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.5(B)

| | TIME(hr.) | | |
|---|---|---|---|
| | 0~240(hr.) | 240~480(hr.) | 480~720(hr.) |
| SAMPLE 2 | 0/100 | 0/100 | 0/100 |

Fig.5(C)
RELATED ART

| | TIME(hr.) | | |
|---|---|---|---|
| | 0~240(hr.) | 240~480(hr.) | 480~720(hr.) |
| CONVENTIONAL SAMPLE | 10/100 | 60/100 | 91/100 |

Fig.6(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.6(B)

| | TIME(hr.) | | |
|---|---|---|---|
| | 0~240(hr.) | 240~480(hr.) | 480~720(hr.) |
| SAMPLE 2 | 0/100 | 0/100 | 0/100 |

Fig.6(C)
RELATED ART

| | TIME(hr.) | | |
|---|---|---|---|
| | 0~240(hr.) | 240~480(hr.) | 480~720(hr.) |
| CONVENTIONAL SAMPLE | 10/100 | 60/100 | 91/100 |

INK RIBBON TO BE USED FOR PRODUCING A DRY TRANSFER MATERIAL

BACKGROUND OF THE INVENTION

1. Field of the Invention

This invention relates to an ink ribbon to be used for producing a dry transferring material and, more particularly, relates to an ink ribbon which can produce a dry transfer image on a transfer sheet that may be subsequently transferred to a receiving material.

2. Description of Related Art

Recently, a device for producing dry transfer material which comprises a transfer sheet for dry transfer material and a ribbon cartridge in which an ink ribbon for producing dry transfer material is stored has been developed and used widely. As such a device, Tape Printer "P-touch" manufactured by Brother industries, Ltd. is well known. A thermal head is installed in the device for producing the dry transfer material. The ink ribbon for producing the dry transfer material is brought in contact with a transfer sheet by the thermal head and a number of heating elements, aligned on the thermal head, are caused to generate heat, according to electrical signals, whereby the ink on the ribbon in contact with the heating elements is heated through a base sheet of the ribbon and fused to the transfer sheet.

Further, as described in U.S. Pat. No. 4,870,427 (corresponding to Japanese Patent Laid-Open SHO NO.63-128990, Japanese Patent Laid-Open SHO NO.63-128991, etc.), the ink ribbon for producing dry transfer material comprises an ink layer which is arranged on a film-like ribbon substrate and contains a resin, having a pressure-sensitive adhesive property and a coloring matter therein, and a control layer which is arranged on the ink layer and contains a resin having a thermo-sensitive adhesive property.

Another ink ribbon for producing dry transfer material comprises, as described in Japanese Patent Laid-Open SHO NO.63-251287, a layer arranged on a film-like ribbon substrate and contains a resin having a pressure-sensitive adhesive property and an ink layer which is arranged on the resin layer. The ink layer contains a resin having a thermal-sensitive adhesive property and a coloring matter.

The user installs a ribbon cartridge, in which an ink ribbon for producing dry transfer material is stored, in the device for producing dry transfer material. The user then inputs the characters or figures, by means of a keyboard or external data source, that the user wants recorded on the dry transfer material. Following the data input, the heat-generating elements of the device corresponding to characters or figures to be recorded are heated according to the input character and figure data. The ink of the ink ribbon for producing the dry transfer material is adhered to a transfer sheet, the sheet being a transparent resin sheet, whereby the dry transfer material, that is the transferred images consisting of characters and figures formed on the transfer sheet, is produced. To use the dry transfer material, the user presses the dry transfer material against a desired surface and transfers the ink to that surface with the application of pressure to a side opposite the ink image.

However, in current transfer material there is a problem that the quality of the transferred image is not good as produced by the transfer from the dry transfer material to the receiving surface.

To transfer the known dry transfer material, the user must place the side of the transfer sheet having the ink transfer image in contact with the surface of the receiving material, such as paper, plastic, metal, or wood, and then the user must rub, for a long period of time, the backside of the transfer sheet.

However, it was difficult to obtain a high quality transfer image because of collapse and spreading of the ink transferred image that resulted if the transfer sheet was insufficiently fixed with respect to the receiving material surface and the transfer sheet shifted position during the rubbing and transfer.

The inventors of the present invention studied the problem and determined the reason why the user had to keep rubbing the transfer sheet for such a long period of time was because the pressure-sensitive adhesive property of the resin, such as, described in EXAMPLE 2, column 18 of U.S. Pat. No. 4,870,427, was weak.

OBJECTS AND SUMMARY OF THE INVENTION

It is an object of the present invention to overcome the above described drawbacks and disadvantages of known transfer materials and to provide an ink ribbon for producing a dry transfer material capable of easily transferring an ink adhered on a transfer sheet to the surface of a receiving material so that the transferred image has a perfect shape without collapse.

Another object of the present invention is to provide an ink ribbon for producing dry transfer material such that there is no residual ink remaining on a transfer sheet when the ink transfer image is transferred onto the surface of the receiving material by applying pressure to the back side of the transfer sheet.

It is another object of the present invention to provide an ink ribbon for producing dry transfer material such that the strength of resistance to scratches or scrapes on a surface of a transferred image will be greatly improved by improving the adherence between the retransferred image and the surface of the receiving material to strongly adhere the transferred image and the receiving material.

It is other object of the present invention to provide an ink ribbon for producing dry transfer material capable of completing the transfer in a very short time by application of a little pressure to the reverse side of the retransfer sheet.

To attain these and other objects, according to the invention, there is provided an image-transferable ink ribbon to be used for producing a dry type image-transfer material, the ink ribbon comprising: a ribbon substrate material and a layer formed on said ribbon substrate material, the layer including the dry type image-transfer material and a microcapsule encapsulated adhesive.

According to the invention thus structured, an ink ribbon for producing dry transfer material has microcapsules containing an adhesive therein emplaced on the ribbon substrate, such that the adhesive does not accomplish its function of adhesion until the microcapsules are ruptured by pressure. Therefore, it is possible to use an adhesive having a stronger adhesive property than that found in the conventional resin used on a ribbon substrate.

As a result, there is no residual ink left on the transfer sheet when the user applies pressure from the reverse side of the transfer sheet and the ink image found on the transfer sheet is transferred to the surface of a receiving material. Further, there is no collapse, spreading and brittleness on the transferred image. The transferred image adheres to the receiving material strongly and an excellent image is obtained.

BRIEF DESCRIPTION OF THE DRAWINGS

The foregoing and other objects, features and advantages of the present invention will become more apparent by reading the following detailed description of the presently preferred embodiments of the present invention, when considered in connection with the accompanying drawings, in which:

FIGS. 4(A)–4(C) are tables of data showing the scrape-resistance of a pressure-sensitive transfer image obtained from the first and second embodiments of the invention and that of the related art;

FIGS. 5(A)–5(C) are tables of data showing the shelf life of the dry transfer material produced from the first and second embodiments of the invention and that of the related art;

FIGS. 6(A)–6(C) are tables of data showing the shelf life of the pressure-sensitive transferred image formed on a receiving material by the dry transfer material produced from the first and second embodiments of the invention and the related art.

DETAILED DESCRIPTION OF THE PREFERRED EMBODIMENTS

Figure 1:
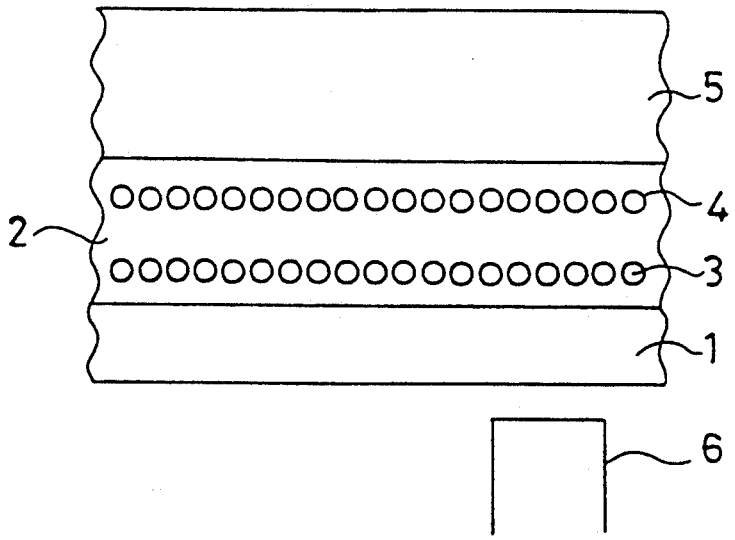
FIG. 1 is an expanded sectional view of a first embodiment of an ink ribbon for producing dry transfer material.

FIG. 1 is an expanded sectional view showing a first embodiment of the ink ribbon of the invention for producing dry transfer material. As shown in FIG. 1, the ink ribbon comprises a film-like ribbon substrate 1 and a pressure-sensitive retransfer adjustment layer 2 having an ink layer 5 provided thereon. The pressure-sensitive retransfer adjustment layer 2 is a layer which includes microcapsules 4 containing an adhesive 3. The ink layer 5 is a layer containing a coloring agent, a thermo-sensitive adhesive component and a pressure-sensitive adhesive component.

The ink ribbon is used with a printing device having a thermal head 6 having a number of heat-generating elements (not shown) and an electrical circuit for heating only those heat-generating elements which correspond to characters or figures to be recorded on a transfer sheet after the characters and figures have been defined by an operation using an input device.

The adhesive 3 used in the present invention is not particularly limited but must have the characteristics of stiffening in a very short time and having a simultaneous development of adhesive strength. That is, it is preferable that the adhesive be of a cyanoacrylate instantaneous adhesive of a one-fluid type, an epoxy adhesive of two main fluids, an acrylic adhesive of two main fluids, a two-fluid type acrylic adhesive having a main-fluid and a primer, or a cyanoacrylate instantaneous adhesive having a main-fluid and a primer.

As the wall material of the microcapsule 4, that is ruptured by an external pressure, well-known materials such as melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, polyurethane resin, and polyurea can be used.

It is desirable that the diameter of the microcapsule 4 be with range of 0.1–20 μm, and, preferably, is in the range of 0.5–10 μm, in order to obtain an excellent transfer image on a receiving material using a pressure equivalent to a stamp pressure in the range of 50 g/cm$^2$ –2000 g/cm$^2$. If the diameter of the microcapsule 4 is less than 0.1 μm, the microcapsule does not rupture easily and the lowest pressure necessary to rupture the microcapsule is increased greatly. On the other hand, if the diameter of the microcapsule 4 is more than 20 μm, crisp transferred images of small characters or figures, for example, are not obtained.

The desirable coating thickness of the layer 2 containing the microcapsules 4 is in the range of 1–20 μm, and preferably in the range of 1–10 μm. If the coating thickness of the layer 2 containing the microcapsules 4 is less than 1 μm, the adhesive strength necessary to obtain excellent pressure-sensitive transfer is not obtained. On the other hand, if the coating thickness of the layer 2 containing the microcapsules 4 is more than 20 μm, the transferred image may be bled by an excessive adhesive and the sharpness and crispness of the transferred image may be lost.

As the film-like ribbon substrate 1 for the ink ribbon, various materials may be used for the thermo-sensitive transfer ink ribbons. Because the film-like ribbon substrate 1 is brought into contact with a thermal head for thermal transfer printing, the film-like ribbon substrate 1 preferably has a heat resistance of 150 degrees C. or higher. Thus polyester films, such as polyethylene terephthalate '(PET) and polybutylene terephthalate, polyimide films, polycarbonate films, polysulfone films, polyethersulfone films, and polyphenylene sulfide films, or papers, such as condenser paper and glassine paper may be used.

A desirable thickness of the film-like ribbon substrate 1 is in the range 1–30 μm. In particular, the optimum thickness is in the range of 3–20 μm, in order to obtain an excellent transferred image using a pressure equivalent to a stamp pressure in the range of 50 g/cm$^2$ –2000 g/cm$^2$. If the thickness of the film-like ribbon substrate is less than 1 μm, the ink ribbon is not smoothly transported in the printing device. On the other hand, if the thickness of the film-like ribbon substrate is more than 30 μm, sufficient heat from the heat generating elements of the thermal head 6 is not transmitted to the pressure-sensitive retransfer adjustment layer 2 and the ink layer 5 for them to be adequately transferred onto the transfer sheet 7.

The ink layer 5 is mainly composed of a coloring agent, a thermo-sensitive adhesive component, and a pressure-sensitive adhesive component. Pigments such as carbon black are generally used as the coloring agent. However, if desired, dyes such as a leuco dye, to be colored by an acid, and a diazo dye, to be colored by a base, may be added to adjust the color tone of the ink, although the invention is not limited to the identified coloring agents.

As a coloring element of the leuco dye, to be colored by an acid, well-known materials such as phthalide compound, fluoran compound, lactone compound, triphenylmethane compound, rhodamine lactam compound, and quinone compound can be used. As a developer for making the leuco dye colored, phenol materials or acid materials are mainly used. The color reaction progresses based on the coloring element and the coloring temperature.

The diazo dye to be colored, by a base, is constructed combining a diazo compound which is an acid material and a coupling compound which is basic dyeprecursor. It is colored based on the contact of the materials which is caused by being heated.

The thermo-sensitive adhesive component of the ink layer 5 may be composed of one or more kinds of resin having high thermo-sensitive adhesiveness, such as ethylene-vinyl acetate copolymer, poly(vinyl acetate), ionomer, acrylic polymer, ethylene-ethyl acetate copolymer, ethylene-acrylic acid copolymer, vinyl chloride-vinyl acetate copolymer, poly(vinyl butyral), poly(vinyl pyrrolidone), poly(vinyl alcohol), polyamide, and ethyl cellulose.

The pressure-sensitive adhesive component of the ink layer 5 may be composed of one or more kinds of material in combination selected from a group consisting of: vinyl polymers such as poly(vinyl chloride), poly(acrylic eater), ethylene-vinyl acetate copolymer, ethylene-ethyl acetate copolymer, poly(vinyl acetate), poly(vinyl ether), poly(vinyl acetal), and polyisobutylene; fibrous polymers such as ethyl cellulose, nitrocellulose and cellulose acetate; and rubber(-like) polymers such as rubber chloride and natural rubber.

In addition, a tackifier, a binder agent and a surface modifier may also be contained in the thermo-sensitive adhesive and the pressure-sensitive adhesive components.

The tackifier acts to improve the adhesion and hardness of an ink, to give cohesion and tacking strength to the ink, and to give tackiness to the thermo-sensitive adhesive and the pressure-sensitive adhesive components. The tackifier may be composed of a mixture of one or more kinds of resin such as petroleum resin, rosin resin, ketone resin, polyamide resin, and phenolic resin.

The binder agent primarily used is one composed of waxes. The wax may be composed of one or more kinds of material selected from: plant waxes such as candelilla wax, carnauba wax, rice wax, and Japan wax; animal waxes such as bees waxes, lanolin, and whale waxes; mineral waxes such as montan waxes and ceresin; and petroleum waxes such as paraffin wax and microcrystalline wax. Also resin waxes such as α-olefin-maleic anhydride copolymers may be used.

The surface modifier enables the ink ribbon to have a excellent shelf life, without one layer of ribbon sticking to another (blocking), and to have an excellent running property, without the meander and slipping caused by losing the tackiness on a surface of the ink ribbon, by reducing the frictional resistance. As the surface modifier, well-known materials such as fluorine-contained polymer and silicone polymer may be used.

On the reverse side of the film-like ribbon substrate 1, to that on which the pressure-sensitive retransfer adjustment layer 2 and ink layer 5 are coated, may be placed an anti-sticking layer which may be composed at least of one or more kinds of material selected from a heat-resistant resin such as silicon resin, and pigments such as barium sulfate, titanium oxide, aluminium hydroxide, zinc oxide and calcium carbonate having a color corresponding to that of the firm-like ribbon substrate.

The present invention is explained with reference to the following Examples, but the present invention should not be construed as being limited thereto.

EXAMPLE 1

As shown in FIG. 1, a pressure-sensitive retransfer adjustment layer 2, which contains an adhesive 3, and an ink layer 5 are placed on a film-like ribbon substrate 1 in order. The ink layer 5 is a layer which contains a coloring agent and a thermo-sensitive adhesive component.

Figure 2:
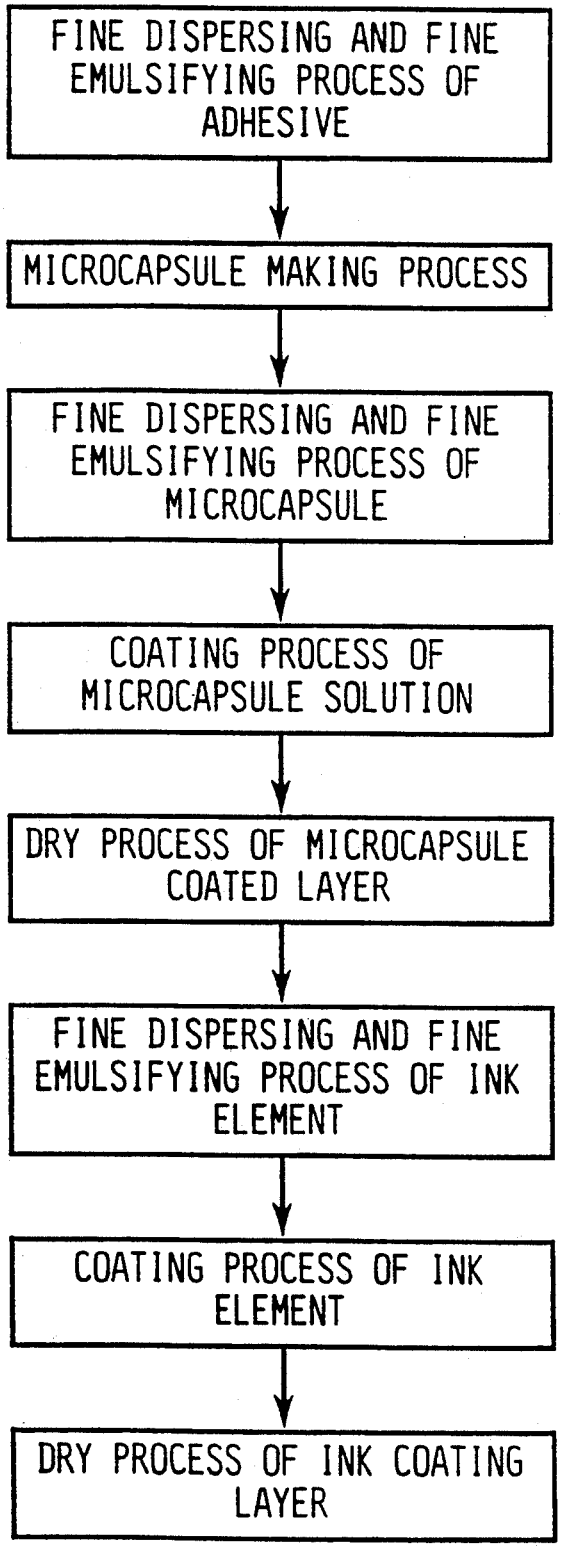
FIG. 2 is a block diagram showing a manufacturing process for the ink ribbon for producing dry transfer material.

Next, one embodiment of the present invention is explained with reference to a manufacturing process, for an ink ribbon used for producing dry transfer material, shown in FIG. 2.

First, a fine dispersing and fine emulsifying process of an adhesive is performed. The process makes a fine dispersing solution or an' emulsifying solution containing a cyanoacrylate instantaneous adhesive 3, of one-fluid type, by adding the cyanoacrylate instantaneous adhesive 3 to an oil solvent by stirring to atomize the cyanoacrylate instantaneous adhesive 3 therein. A dispersant or an emulsifier is added to the stirred and atomized cyanoacrylate instantaneous adhesive 3 in order to maintain a stable solution or emulsion.

A microcapsule making process is then performed by adding melamine to the stable solution or emulsion of the fine dispersing and fine emulsifying process. The mixture is heated and an oil solvent containing dissolved formaldehyde is added to the heated mixture with stirring to disperse the dissolved formaldehyde throughout the mixture. As a result, a crosslinking polymer of the melamine and the formaldehyde is formed on an interface of a formaldehyde dispersion grain thereby producing the melamine-formaldehyde resin microcapsules containing the cyanoacrylate instantaneous adhesive.

Next, a fine dispersing and fine emulsifying process of the microcapsules 4 is performed. The microcapsules 4 and a binder wax are added to an oil solvent. The resultant mixture is stirred to disperse the microcapsules and binder wax throughout the solvent and a dispersant is added to create a stable solution or emulsion. The microcapsule solution is then coated on a polyethylene terephthalate (PET) film-like ribbon substrate 1 by a known coating method such as the bar coating method, the blade coating method, the air-knife coating method, the gravure coating method, the roll coating method, the spray coating method or the dip coating method.

Immediately after being coated on the film-like ribbon substrate the microcapsule coated layer is heated and dried using a temperature of 110° C. As a result, a pressure-sensitive retransfer adjustment layer 2 is formed on the film-like ribbon substrate 1 by drying the microcapsule coated layer.

Next, an ink element is subjected to a fine dispersing and fine emulsifying process whereby a fine dispersing solution or an emulsifying solution containing a coloring agent and a thermo-sensitive adhesive component is made by adding a dispersant or an emulsifier after stirring and atomizing the coloring agent and the thermo-sensitive adhesive component.

The fine dispersing solution or the emulsifying solution of the ink element is then coated on the pressure-sensitive transfer adjustment layer 2 by a known coating method such as the bar coating method, the blade coating method, the air-knife coating method, the gravure coating method, the roll coating method, the spray coating method or the dip coating method.

The film-like ribbon substrate 1, to which the ink element is coated is heated and dried at a temperature of 110° C. and the drying process produces the ink layer. As a result, the ink coating layer which is formed on the pressure-sensitive retransfer adjustment layer 2 and an ink ribbon for producing dry transfer material of the invention is formed.

Figure 3:
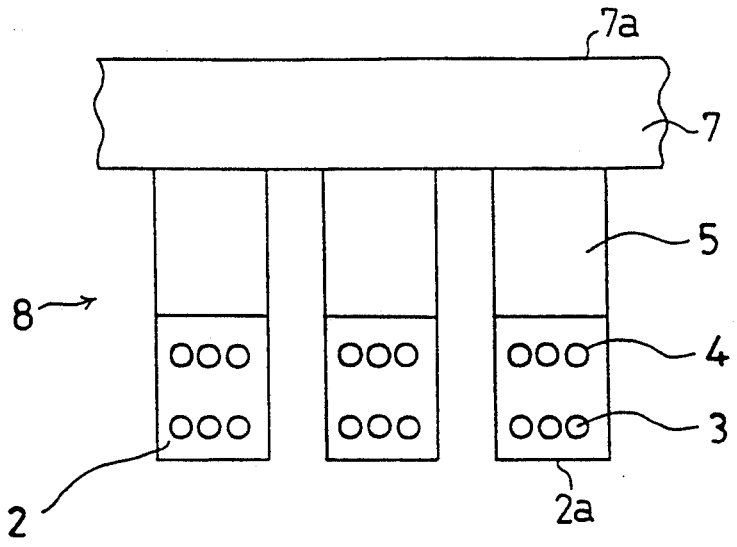
FIG. 3 is an expanded sectional view of a dry transfer sheet of the first embodiment.

FIG. 3 is an expanded sectional view of a dry transfer material made using the just described ink ribbon for producing dry transfer material of the invention. The dry transfer material 8 has an ink layer 5 and a pressure-sensitive retransfer adjustment layer 2 including the microcapsules 4 containing an adhesive 3 layered on the transfer sheet 7.

The procedure for manufacturing the dry transfer material 8 will now be briefly explained.

First, the ink ribbon for producing dry transfer material of the present invention is placed in a ribbon cartridge. The ribbon cartridge is installed in a device for producing dry transfer material (for example, Tape Printer "P-touch" manufactured by Brother industries, Ltd.) having a built-in thermal head 6.

Data to be recorded on the transfer sheet 7 is input, and heat-generating elements of the thermal head 6, corresponding to characters or figures to be recorded, are heated to a temperature greater than the melting temperature of the pressure-sensitive retransfer adjustment layer 2 and the ink layer 5. Therefore, the ink transfer image is thermo-sensitively transferred from the ink ribbon onto the transfer sheet 7 to produce dry transfer material 8 having the desired ink transfer images thereon. When side 2A of the dry transfer material 8 on which the ink transfer image is formed, is placed on the surface of receiving material, and a pressure equivalent to the stamp pressure is applied to side 7A of the dry transfer material 8, the microcapsules 4 are ruptured, and the adhesive contained therein flows out, and the desired ink transfer image is pressure-sensitively transferred onto the receiving material surface, such as the surface of paper, plastic, metal, and wood. The result is transferred image having an excellent image quality without collapse, spreading, or brittleness.

The stamp pressure necessary for pressure-sensitive transfer is set primarily according to the pressure necessary to rupture the microcapsules 4. The desirable, as previously noted, stamp pressure is 50 g/cm$^2$ - 2000 g/cm$^2$. In particular, the optimum stamp pressure is 200 g/cm$^2$ -1000 g/cm$^2$ which obtains an excellent transferred image without excessive effort. If the dry transfer material is such that the microcapsules 4 included therein may be ruptured with a stamp pressure of less than 50 g/cm$^2$, the microcapsules are too easily ruptured and the pressure-sensitive transfer is too easily performed resulting in scratching and smearing of the image. Therefore, the shelf life of the dry transferring material decreases as it is easily damaged. On the other hand, if the dry transfer material is such that the microcapsules 4 included therein are ruptured by a stamp pressure of more than 2000 g/cm$^2$, the microcapsules 4 are not easily ruptured and an excellent pressure-sensitive transferred image is not obtained.

Moreover, because an adhesive that stiffens in a very short time and simultaneously obtains its adhesive strength is used in the invention, the transferred image is obtained in a very short time.

To determine the improvement over conventional transferred images, a scratch strength of the transferred image obtained by the above-mentioned method and a conventional transferred image were measured. The comparison of their scrape-resistance is shown in FIGS. 4(A) and 4(C), respectively. Sample 1 is based on a transferred image obtained by using a dry transfer material made from the ink ribbon of example 1. The conventional transferred image, which was considerably less scratch resistant, was obtained using a dry transfer material made from a conventional ink ribbon which does not use microcapsule contained adhesive.

Compared with the conventional transferred image, the adhesiveness between the transferred image obtained by using the dry transfer material made from the ink ribbon for producing dry transfer material of this example 1, of the invention, and the receiving material is greatly improved. It is found that the scrape-resistance such as scratch strength is greatly improved and increases because the retransferred image is firmly transferred to the surface of the receiving material.

The results of observing and comparing the shelf life of the dry transfer material made from the ink ribbon, for producing dry transfer material of example 1 of the invention, and the conventional dry transfer material are shown in FIGS. 5(A) and 5(C). The results of observing and comparing the shelf life of the transferred image on the surface of the receiving material made from the ink ribbon, for producing the dry transfer material, of example 1 of the invention and the conventional transferred image are shown in FIGS. 6(A) and 6(C).

The conditions for observation and comparison for both the dry transfer material and the transferred image were visual observation after being left at an ambient temperature of 55 degrees C. and 85% relative humidity. One hundred examination samples of the result of using the invention and of the conventional materials were visually inspected for bleedings, cracks and changes of hue.

As stated, in example 1 the pressure-sensitive retransfer adjustment layer 2 containing the microcapsule encapsulated adhesive was used. Neither dry transfer material nor the transferred image produced using the ink ribbon of example 1 shows any cracks, bleedings and changes of hue even after 480–720 hours passed. However, the conventional transferred image, and the conventional transfer material showed some bleedings, cracks and changes of hue before 240 hours passed, and the number of defects increased with the passing of time. Therefore, it was found that the shelf life of the conventional transferred image and the conventional transfer material was inferior to that produced by the ink ribbon of the invention.

EXAMPLE 2

Figure 7:
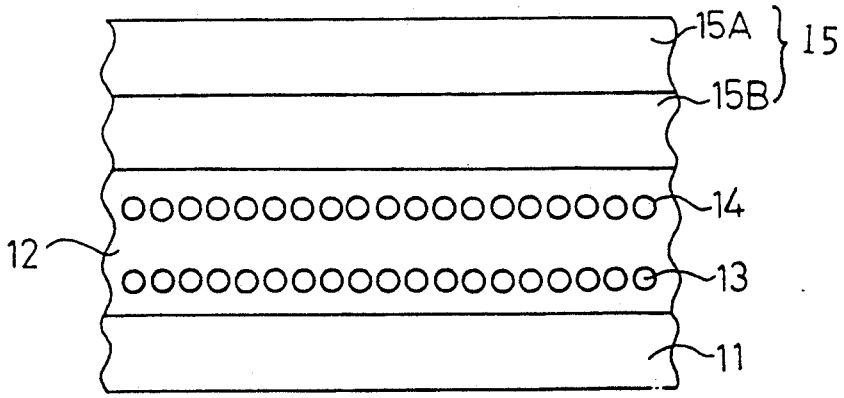
FIG. 7 is an expanded sectional view of a second embodiment of an ink ribbon for producing dry transfer material.

Shown in FIG. 7 is a second embodiment of a dry material transfer producing ink ribbon. The ink ribbon of the second embodiment comprises a pressure-sensitive transfer adjustment layer 12, which contains microcapsules 14 containing an adhesive 13, and an ink layer 15 are installed in order on a film-like ribbon substrate The ink layer 15 comprises two layers, that is a thermo-sensitive adhesive component 15A and a pressure-sensitive adhesive component 15B which contains a coloring agent. The pressure-sensitive adhesive component 15B is closest to the film-like ribbon substrate 11.

As was the case with example 1, the dry transfer material, made from an ink ribbon for producing the dry transfer material, and its pressure-sensitive transferability were examined. It was found a transferred image having an excellent quality without collapses, spreadings, and brittleness was obtained as a result of the adhesive flowing from the ruptured microcapsules, after rupture by an external pressure equivalent to a stamp pressure, stiffened in a moment.

Moreover, because the adhesive, which stiffened in a very short time and, simultaneously obtained its adhesive strength, used was the same as that of example 1, the transferred image could be obtained in a very short time.

The results of measuring the scratch strength of the transferred image obtained from the dry transfer material produced from the ink ribbon of example 2 (sample 2) and the conventional transferred image and comparing their resultant scrape-resistance are shown in FIGS. 4(B) and 4(C).

As compared with the conventional transferred image, it was found that the adhesiveness between the transferred image obtained by using the dry transfer material made from the ink ribbon for producing dry transfer material of example 2 of the invention and the surface of the receiving material is greatly improved. It was found that the scrape-resistance, that is scratch strength, is greatly improved over the conventional transferred image because the transferred image resulting from the invention is more firmly transferred and adhered to the received material.

Further, the results of observing and comparing the shelf life of the dry transfer material and of the transferred image, as was done with example 1, are shown in FIG. 5(B) and FIG. 6(B) respectively.

As in example 1, in example 2 the pressure-sensitive retransfer adjustment layer contained the microcapsule encapsulated adhesive. Therefore, the dry transfer material and the transferred image obtained using the ink ribbon of example 2 showed no cracks, bleedings or changes of hue even after 480–720 hours had passed. However, as stated earlier, the conventional transferred image showed bleedings, cracks or changes of hue before 240 hours had passed, and their numbers increased with the passing of time. Therefore, it was found that the shelf life of the conventional transferred image was inferior to that produced by dry transfer materials made using the ink ribbon of example 2 of the invention as well as that of example 1.

While this invention has been described in connection with specific embodiments thereof, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An image-transferable ribbon to be used for producing a transfer sheet comprising:

a ribbon substrate material; and a layer formed on a ribbon substrate material, said layer including a dry image-transfer material and a microcapsule encased adhesive.

2. The image-transferable ribbon as defined in claim 1, wherein said layer includes a second layer formed directly on a surface of said ribbon substrate material, said second layer comprising a retransfer adjustment layer including said microcapsule encased adhesive with a remainder of said layer overlying said second layer, said remainder comprising said dry image-transfer material.

3. The image-transferable ribbon as defined in claim 2, wherein the diameter of each said microcapsule is 0.1 – 20 micrometers.

4. The image-transferable ribbon as defined in claim 2, wherein an outside wall of each said microcapsule is formed to be ruptured by the force of 50 g/cm$^2$ –2000 g/cm$^2$.

5. The image-transferable ribbon as defined in claim 2, wherein said retransfer adjustment layer containing said microcapsule encased adhesive is 1 – 20 micrometers thick.

6. The image-transferable ribbon as defined in claim 4, wherein the material forming an outside wall of each of said microcapsule comprises one of a group of materials consisting of melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, polyurethane resin, and polyurea.

7. The image-transferable ribbon as defined in claim 2, wherein said adhesive comprises a rapid stiffening adhesive.

8. An image-transferable ribbon to be used for producing a dry type image-transfer material comprising:

a ribbon substrate material;

a retransfer adjustment layer formed on said ribbon substrate material, said transfer property control layer including a microcapsule encased adhesive; and an ink layer formed on said retransfer adjustment layer.

9. An ink ribbon for producing dry transfer materials, comprising:

a ribbon substrate;

an adhesive layer adhered to said ribbon substrate, said adhesive layer containing a microcapsule encased adhesive; and an ink layer adhered over said adhesive layer.

10. The ink ribbon as claimed in claim 9, wherein said ink layer comprises a first layer containing a pressure-sensitive adhesive component next to said adhesive layer and a second layer containing a temperature-sensitive adhesive component overlying said first layer.

11. The ink ribbon as claimed in claim 10, wherein said first layer contains a coloring agent.

12. The ink ribbon as claimed in claim 9, wherein a diameter of said microcapsules are in a range of 0.1 to 20 micrometers.

13. The ink ribbon as claimed in claim 12, wherein the range of said diameter is 0.5 to 10 micrometers.

14. The ink ribbon as claimed in claim 9, wherein said adhesive layer is 1 to 20 micrometers thick.

15. The ink ribbon as claimed in claim 14, wherein said adhesive layer is 1 to 10 micrometers thick.

16. The ink ribbon as claimed in claim 9, wherein said microcapsules rupture under a pressure in a range of 50–2000 g/cm$^2$.

17. The ink ribbon as claimed in claim 16, wherein said range where said microcapsules rupture is 200–1000 g/cm$^2$.

* * * * *